US007812331B2

(12) United States Patent
Wickland et al.

(10) Patent No.: US 7,812,331 B2
(45) Date of Patent: Oct. 12, 2010

(54) SPHERICAL STORAGE CONTAINERS

(75) Inventors: Terry Wickland, Evergreen, CO (US); Parold Popish, Golden, CO (US); Michael Dean Peterson, Parker, CO (US); Fred Louis Popish, Arvada, CO (US)

(73) Assignee: Nuclear Filter Technology, Inc., Golden, CO (US)

( * ) Notice: Subject to any disclaimer, the term of this patent is extended or adjusted under 35 U.S.C. 154(b) by 631 days.

(21) Appl. No.: 11/727,169

(22) Filed: Mar. 23, 2007

(65) Prior Publication Data

US 2007/0290149 A1 Dec. 20, 2007

Related U.S. Application Data

(60) Provisional application No. 60/784,758, filed on Mar. 23, 2006.

(51) Int. Cl.
*B65D 51/29* (2006.01)

(52) U.S. Cl. ..... 250/506.1; 220/288; 220/303; 220/371

(58) Field of Classification Search ..... 250/506.1, 250/515.1; 376/320; 220/288, 303, 371, 220/642
See application file for complete search history.

(56) References Cited

U.S. PATENT DOCUMENTS 3,929,568 A * 12/1975 Schabert et al. ..... 376/293
5,231,938 A * 8/1993 Gore ..... 110/346
5,325,642 A * 7/1994 Cooley ..... 52/81.1
5,725,645 A 3/1998 Wickland et al.
5,727,707 A 3/1998 Wickland et al.
5,814,118 A 9/1998 Wickland et al.
5,911,332 A 6/1999 Wickland et al.
6,355,078 B1 3/2002 Wickland
6,395,050 B1 5/2002 Wickland et al.
6,413,304 B1 7/2002 Wickland et al.
6,557,428 B2 5/2003 Wickland et al.
6,911,061 B2 6/2005 Peterson et al.
6,935,199 B2 8/2005 Wickland et al.
6,948,391 B2 9/2005 Brassell et al.
7,048,139 B1 5/2006 Peterson et al.
2005/0041094 A1 * 2/2005 Gal et al. ..... 348/36
2007/0246375 A1 10/2007 Wickland et al.
2008/0017644 A1 1/2008 Wickland et al.

* cited by examiner

*Primary Examiner*—Kiet T Nguyen
(74) *Attorney, Agent, or Firm*—Millen, White, Zelano & Branigan, P.C.

(57) ABSTRACT

Spherical storage containers for radioactive materials, such as plutonium oxides and salts, are comprised of coupled hemispheres joined by helical threads or bayonet connections. The spherical storage containers are supported in a barrel by a vertical strut and laterally extending straps or are supported in cylindrically configured frames.

12 Claims, 10 Drawing Sheets

SPHERICAL STORAGE CONTAINERS

RELATED APPLICATION

This application claims priority of Provisional Application Ser. No. 60/784,758, filed Mar. 23, 2006.

FIELD OF THE INVENTION

The present invention relates to spherical storage containers. More particularly, the present invention relates to spherical storage containers especially useful for storing radioactive materials, such as plutonium in the form of oxides and salts, as well as in other forms.

BACKGROUND OF THE INVENTION

Plutonium is a man-made radioactive element which is used as an explosive ingredient in nuclear weapons and as a fuel for nuclear reactors. It has the important nuclear property of being readily fissionable with neutrons and is available in relatively large quantities. Caution must be exercised in handling plutonium to avoid unintentional formation of critical mass. Plutonium in liquid solutions is more apt to become critical than solid plutonium so it is also very important to avoid the unintentional creation of a liquid solution. Since plutonium is considered to be highly carcinogenic, it is important that plutonium in any form be contained and not escape into the surrounding environment where it can be inhaled or otherwise ingested by humans or other living things. Frequently, plutonium oxides and salts are in the form of powders which require very special handling to ensure that particles do not become suspended in the air and that liquid does not come into contact with the powders. Optionally, such containers are vented through high efficiency particulate filters.

SUMMARY OF THE INVENTION

In view of the aforementioned considerations, it is a feature of the present invention to provide new and improved containers for storage of hazardous materials such as radioactive materials.

In view of this feature, spherical containers for hazardous materials comprise a pair of hemispheres having annular rims with complimentary threads for joining the hemispheres. The annular rims are sealed with at least one gasket. An optional self-sealing sample port allows retrieving of a gas sample or allows purging of the container with inert gas. When the hazardous material is nuclear waste, such as solutions or salts containing plutonium, stainless steel or aluminum are the preferred materials from which the containers are fabricated.

In accordance with a first embodiment of the invention, at least one of the hemispheres has a handle used to rotate that hemisphere with respect to the other hemisphere in order to join the hemispheres to define a spherical enclosure containing the hazardous material. Preferably, according to the first embodiment, both hemispheres have handles.

In a further aspect, each handle is U-shaped and pivoted on its respective hemisphere to fold against the hemisphere after the hemispheres are joined to indicate that the container is ready for storage or shipment.

In accordance with a second embodiment of the invention, the spherical container is supported within a surrounding container such as, but not limited to, a barrel by either depending struts or by a frame so that the spherical container is surrounded by space which may contain inert gas.

In one aspect of the invention, when the waste material is transuronic waste, such as solutions of salts of plutonium, the container is fabricated of stainless steel or aluminum.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
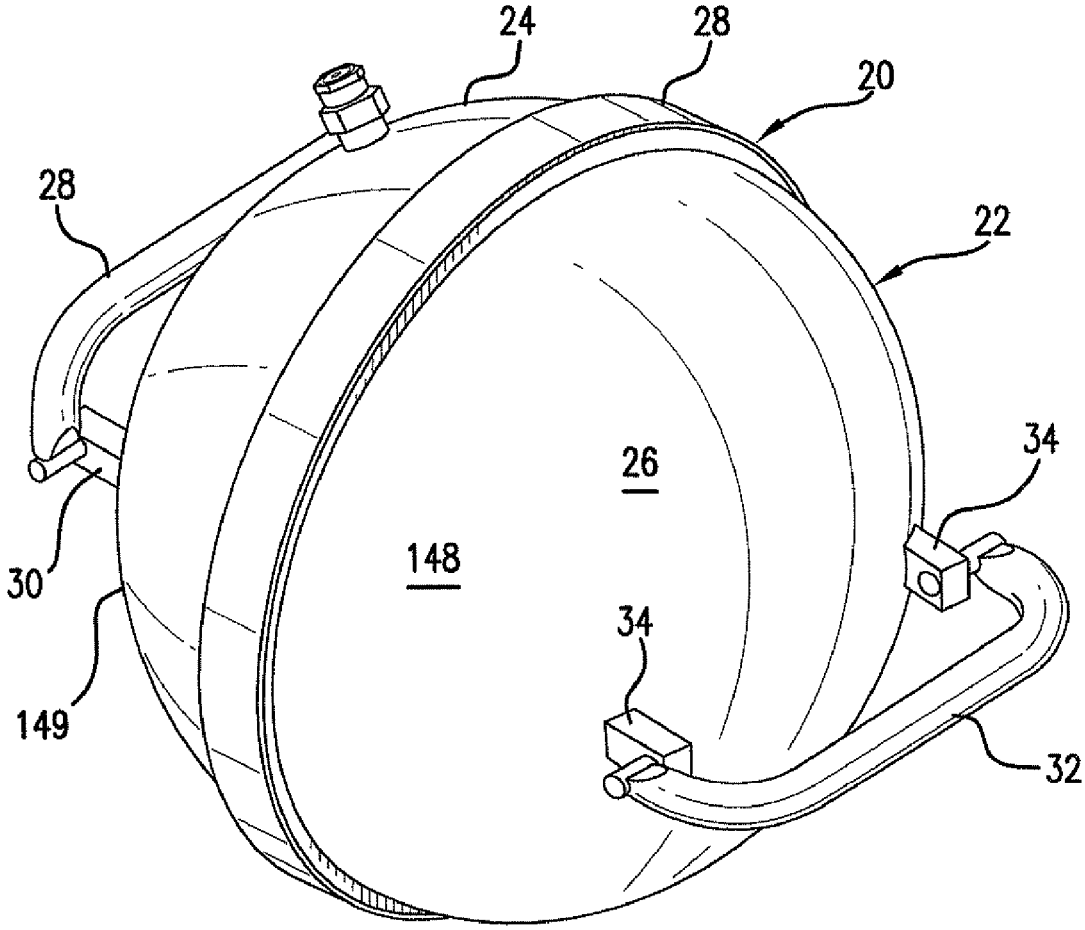
FIG. 1 is a perspective view of a first embodiment of the invention.

Referring now to FIG. 1 there is shown a first embodiment 20 of a spherical container 22 which is useful for storing hazardous waste and especially useful for storing a transuranic hazardous waste such as solutions and salts of plutonium. Spherical container 22 has a first hemisphere 24 and a second hemisphere 26 that are joined by a coupling 28. The coupling 28 may be either a bayonet type coupling or an illustrated threaded coupling.

The first hemisphere 24 has a U-shaped handle 28 pivoted thereto on a pair of flanges 30 while the second hemisphere 26 has a U-shaped handle 32 pivoted thereon by a pair of flanges 34 attached thereto. By gripping one of the handles 28 or 32 in one hand and gripping the other handle in the other hand, the hemispheres 24 and 26 may be rotated relative to one another to either thread the hemispheres together with a threaded coupling 28 or to cam them together with a bayonet-type coupling.

Figure 2:
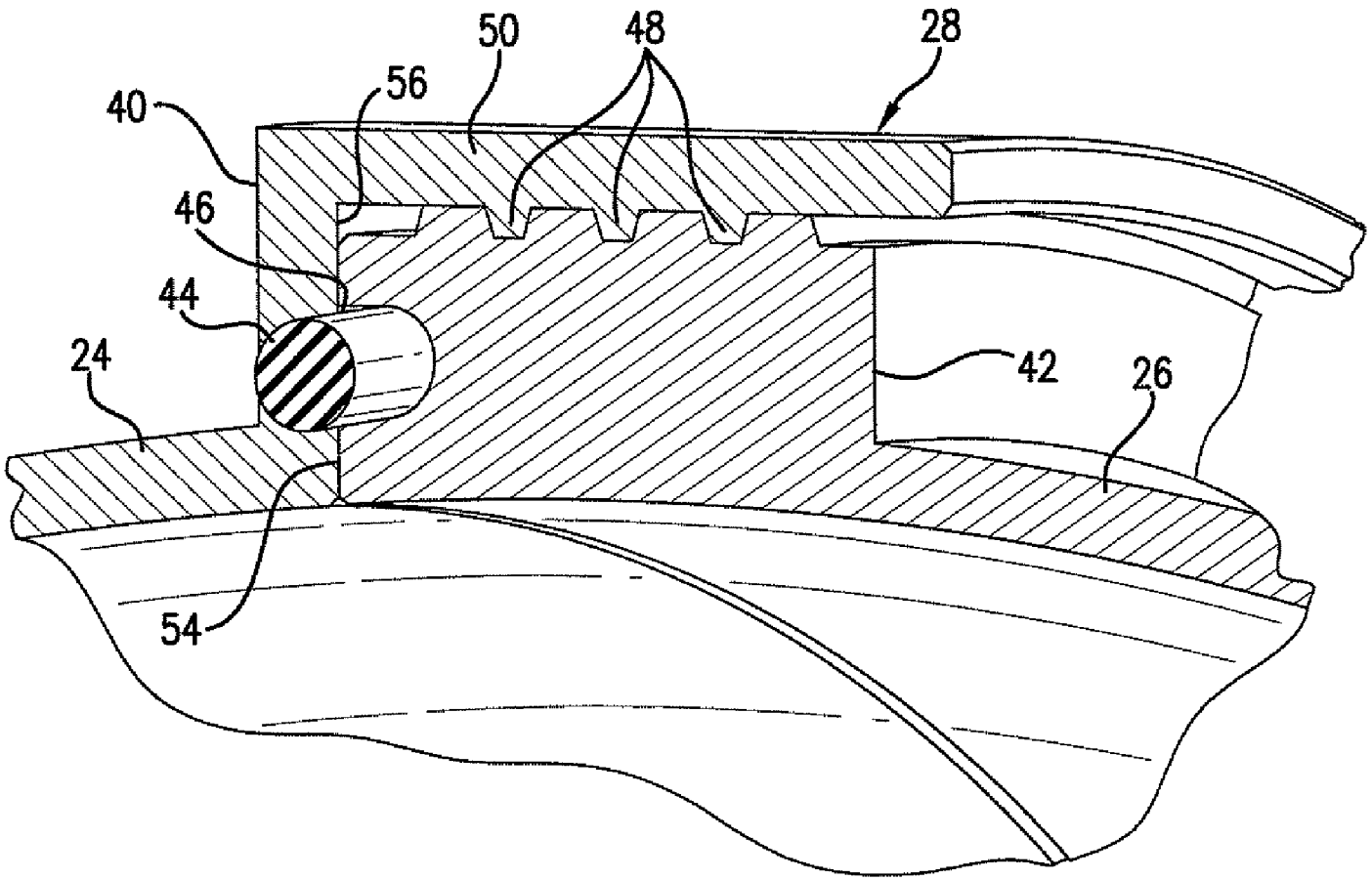
FIG. 2 is a perspective view of a portion of the present invention showing a threaded connection between a pair of hemispheres that comprise the spherical container of FIG. 1.

Referring now to FIG. 2 where an elevation of the coupling 28 is shown enlarged, it is seen that the first hemisphere 24 has an L-shaped annular rim 40 projecting therefrom and the second hemisphere 26 has a block type annular rim 42 projecting therefrom, it is seen that the L-shaped annular rim receives the block, type annular rim therein. As the second hemisphere 26 is rotated with respect to the first hemisphere 24, the block-type annular rim 42 advances into the L-shaped annular rim 24 to compress an O-ring 44 that is received in a slot 46 in the block-type annular ring 42. In the illustrated embodiment, spherical threads 48 on the axially extending portion 50 of the L-shaped annular rim 40 are advanced in spherical grooves 52 formed in the block shaped annular groove 42. When the exposed end 54 of the annular rim 42 abuts the shoulder 56 of the L-shaped annular rim 30, the O-ring 44, which is preferably a Viton O-ring, is compressed to affect a very reliable seal. The spherical threads 48 and spherical grooves 52 are precision machined into the rims 40 and 42.

Figure 3:
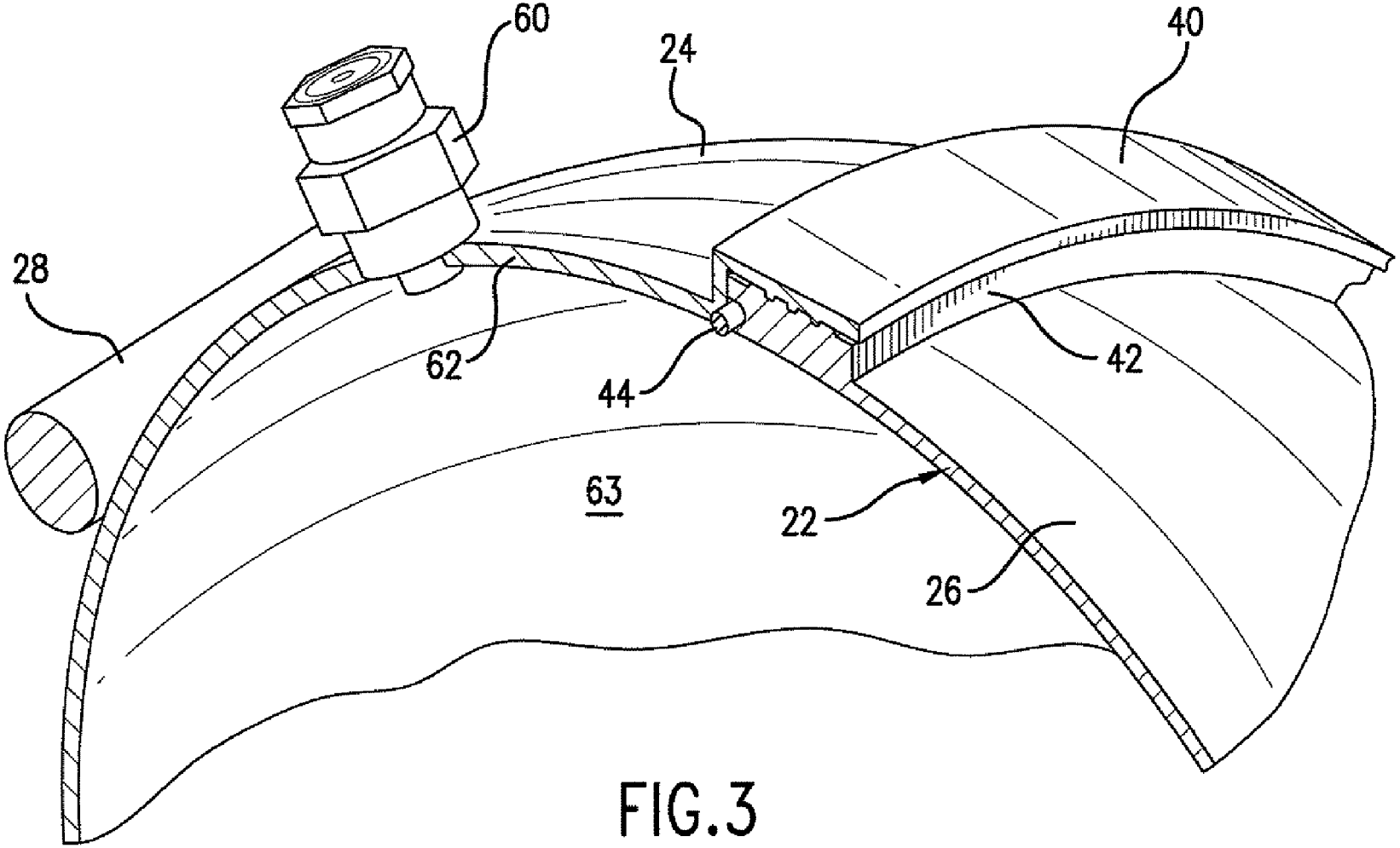
FIG. 3 is a perspective view showing a self-sealing port used with the spherical container of FIGS. 1 and 2.

As is seen in FIG. 3, in combination with FIG. 1, an optional self-sealing sample port 60 is disposed through the wall 62 defining the first hemisphere 24. The sample port allows retrieving a gas sample from the space 63 which contains a hazardous material, such as transuranic waste and/or allows purging of the space 53 with inner gas.

A sealable container 22 is one embodiment comprised of two 14-guage stainless steel hemispheres 24 and 26 spun formed to an 8-inch inside diameter. The fold down handles 28 and 32 are lanes for fast reliable closure and provide a visual verification of seal when folded over. The approximate weight of the empty spherical container 20 is about seven pounds.

Figure 4:
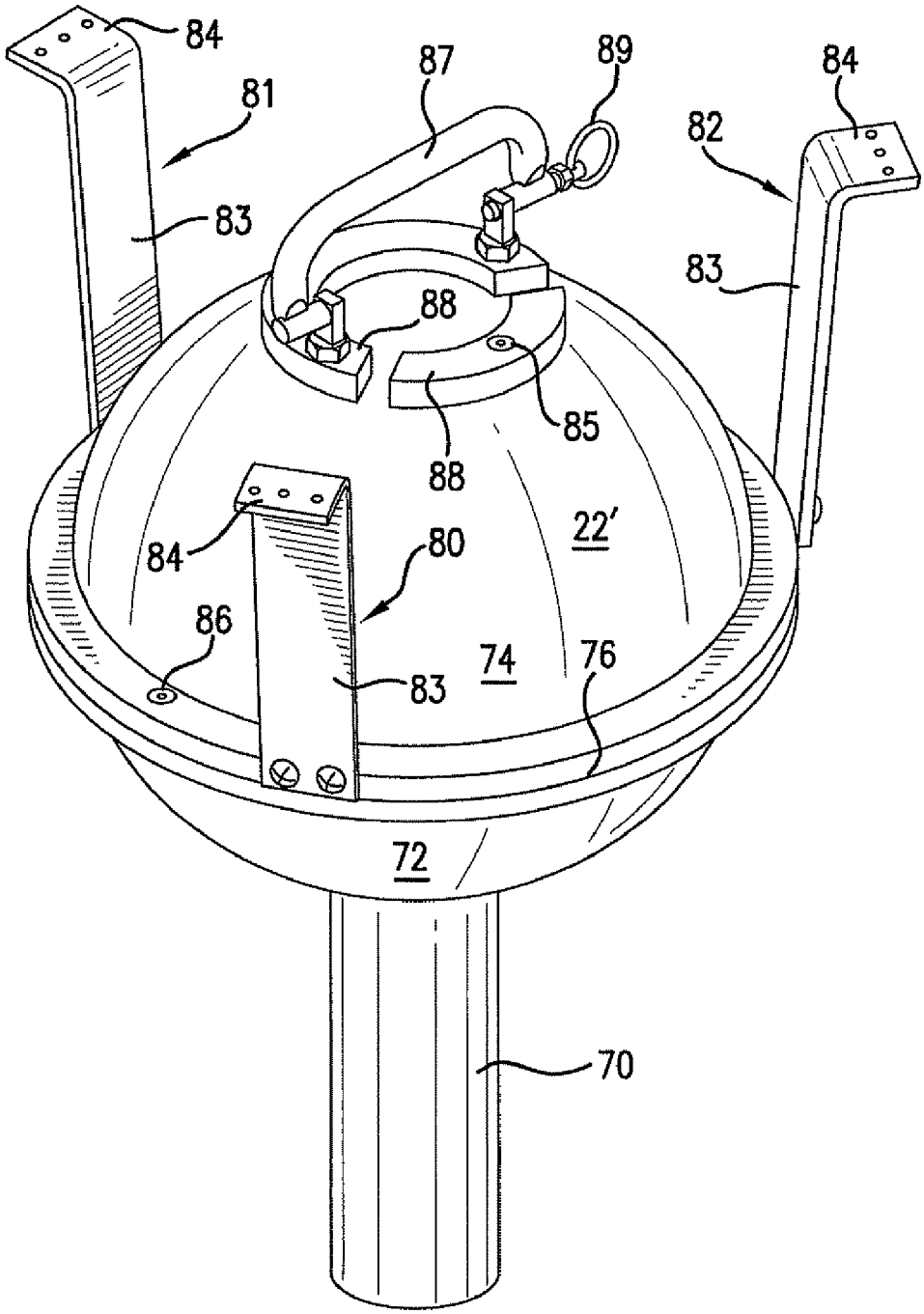
FIG. 4 is a perspective view of a second embodiment of the present invention showing a spherical container with struts for mounting the container in a surrounding container.

Referring now to a second embodiment of the invention shown in FIG. 4, it is seen in FIG. 4 that a spherical container 22' has a cylindrical aluminum tube 70 extending from a lower hemisphere 72. The upper hemisphere 74 which has been joined to the lower hemisphere 72 by coupling rim portions 76 have three straps 80, 81 and 82 extending vertically therefrom. The straps 80-82 are L-shaped with each strap having a long leg 83 and a short leg 84. The long leg 83 is bolted to an exterior surface of the coupling ring 76 while the short leg has screw holes for bolting to a container in which the spherical container 22' is mounted. The cylindrical aluminum member 70 is a strut which supports the container from the bottom in a barrel, while the L-shaped brackets can be bolted to a top rim or lid of the barrel.

A first sampling port 85 allows one to sample the interior of the spherical container 22' while the second port 86 allows one to sample the sealing area defined by the coupling 76.

A handle 87 is pivoted on arculate reinforcements fixed to the top surface of top hemisphere 74. U-shaped handle 87 can be disconnected from the top hemisphere 74 by pulling a locking pin 89.

Figure 5:
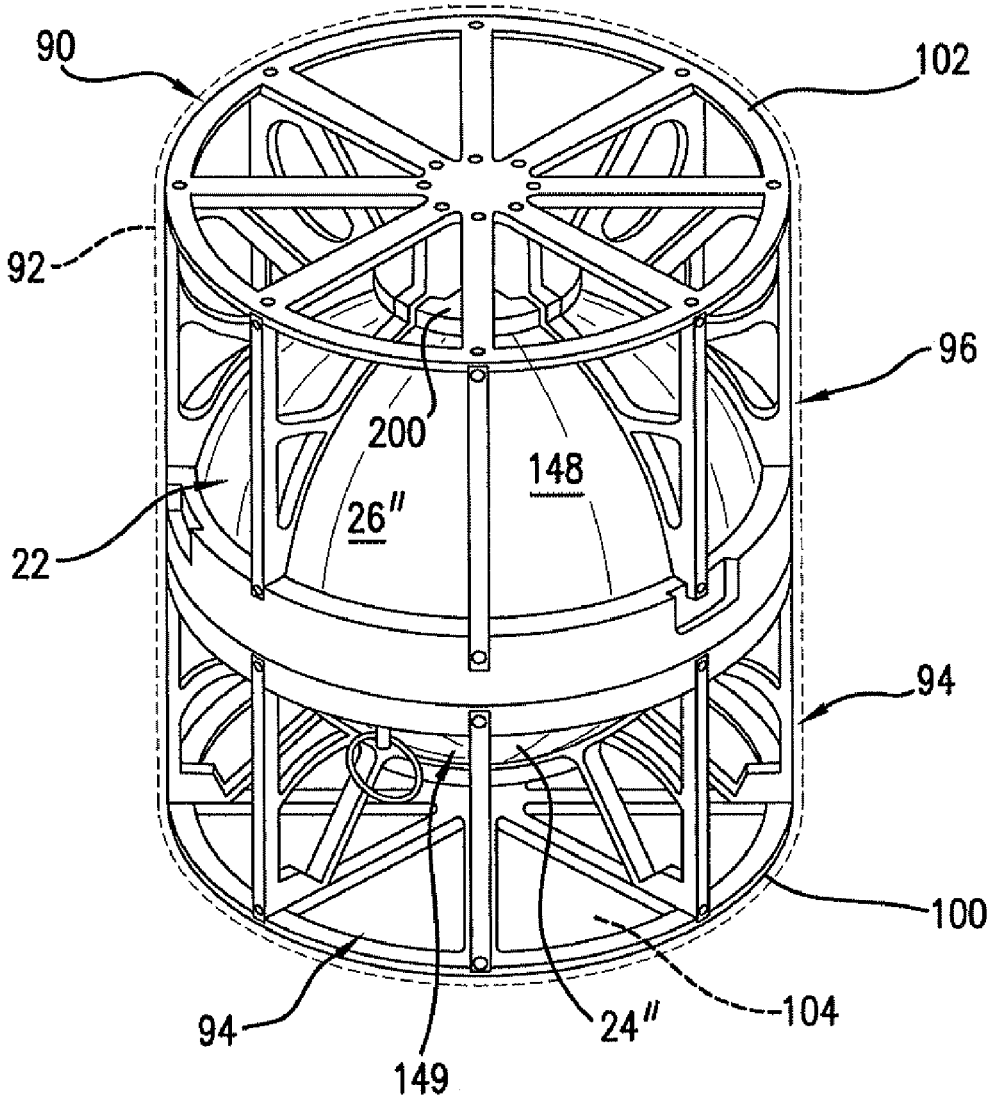
FIG. 5 is a perspective view of a third embodiment of the present invention.
Figure 6:
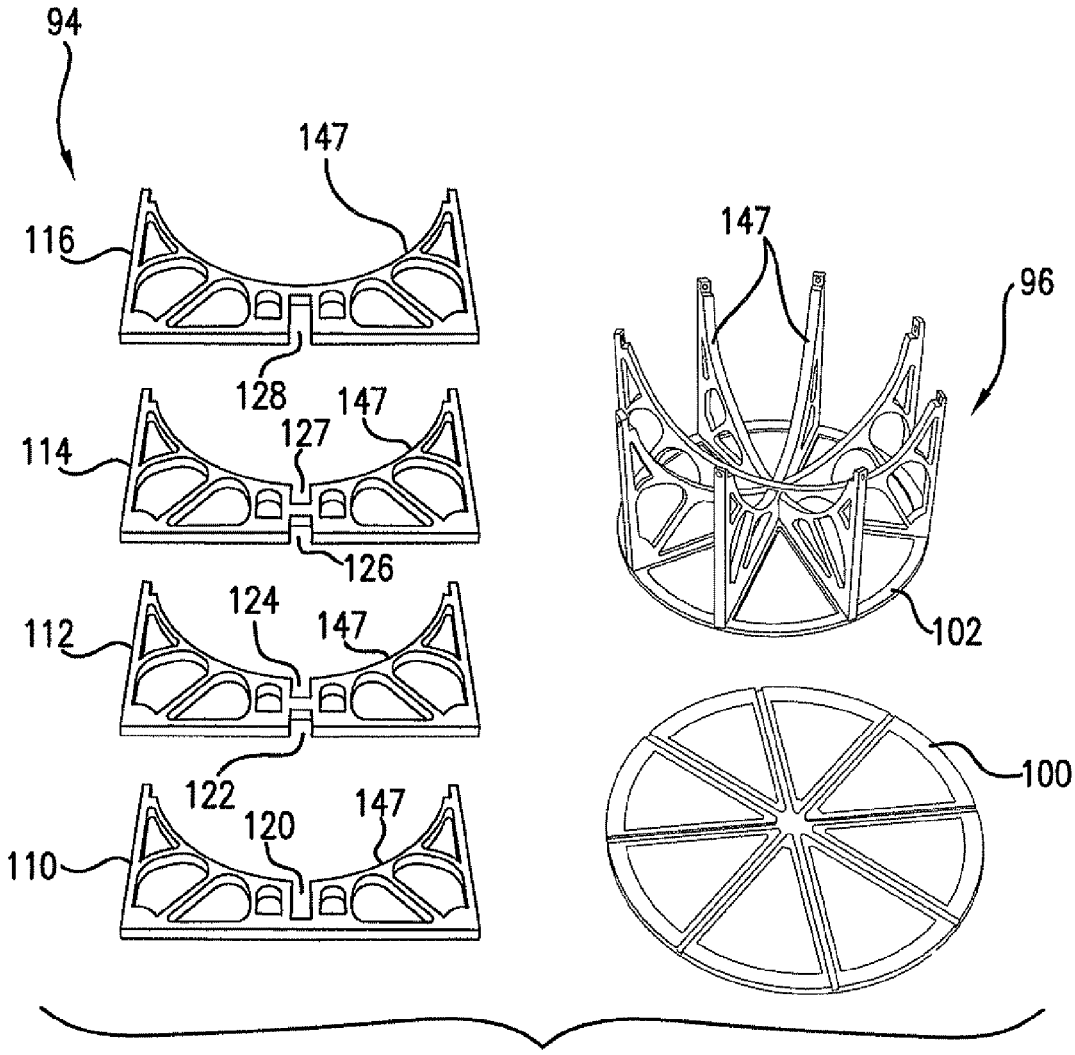
FIGS. 6 and 7 are photographs showing various parts of the third embodiment with FIG. 7 showing an upper hemisphere assembled in a frame

Referring now to FIG. 5 there is shown a third embodiment of the invention wherein the spherical container 22", formed of lower hemisphere 24" and an upper hemisphere 26", and is caged in a cylindrical frame assembly 90 for mounting in an outside container such as a barrel, illustrated by the dotted lines 92. FIG. 6 shows elements of the frame assembly 90 used to support the spherical container 22' of FIG. 5. The frame 90 has a lower frame assembly 94 and an upper frame assembly 96. The lower and upper assemblies 94 and 96 are configured of nested brackets that are fixed to a lower spoked rim 100 and upper spoked rim 102. A lower spoked rim 100 is positioned at the lower end 104 of the barrel 92 and the upper spoked rim 102 is positioned adjacent the top or lid of the barrel 92.

Figure 7:
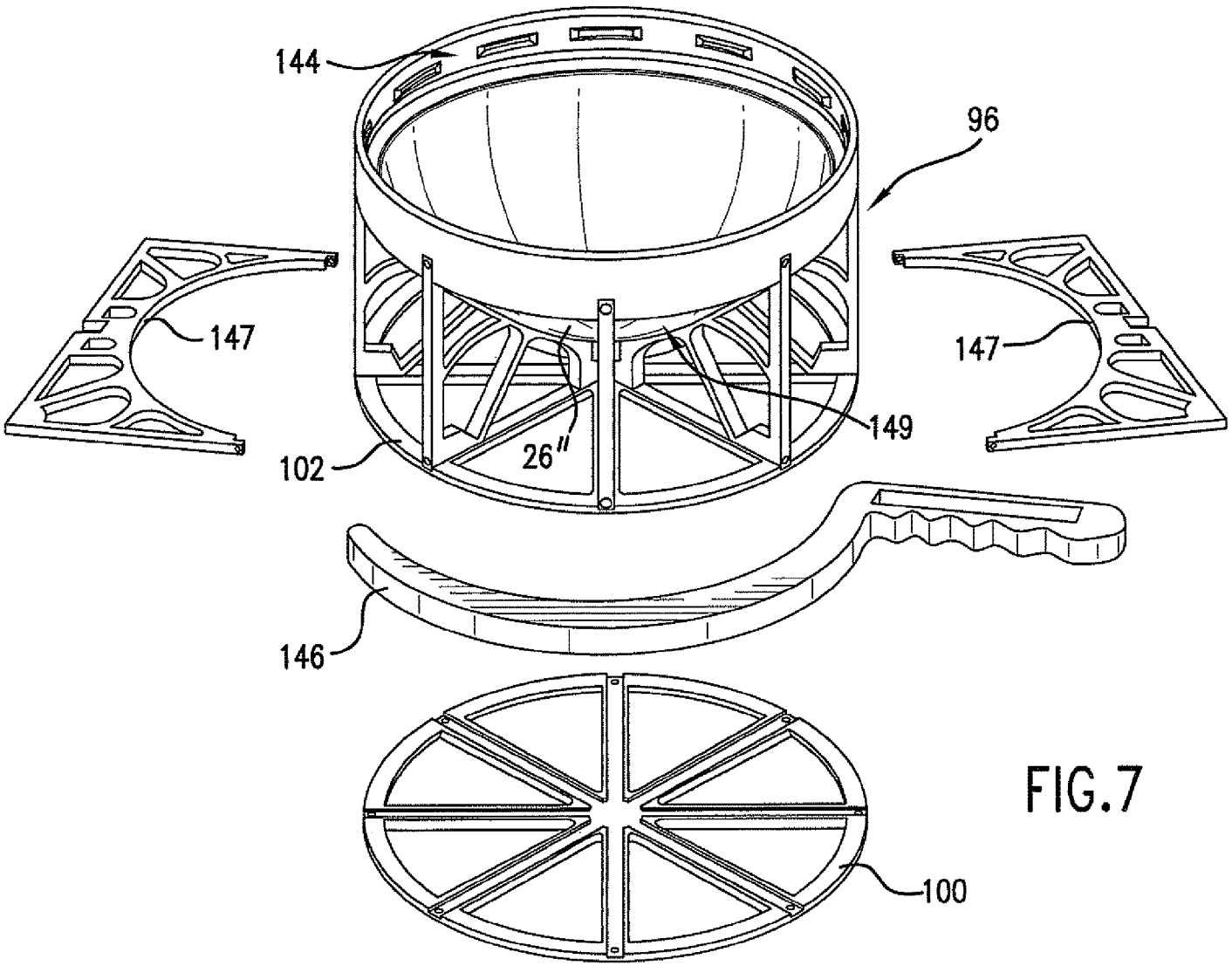
Figure 8:
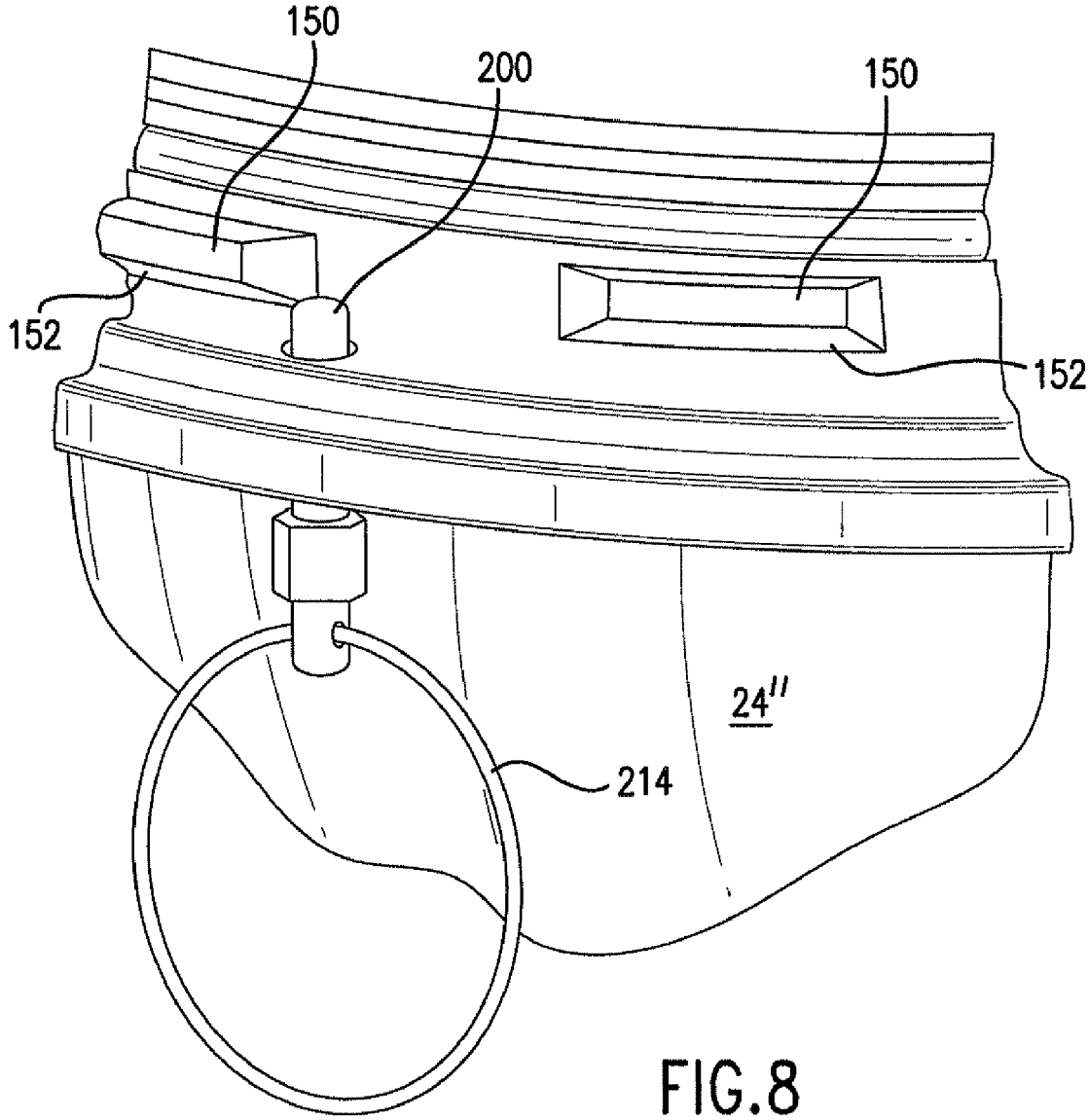
FIG. 8 is a perspective view of a portion of a lower hemisphere with bayonet lugs and locking pin.
Figure 9:
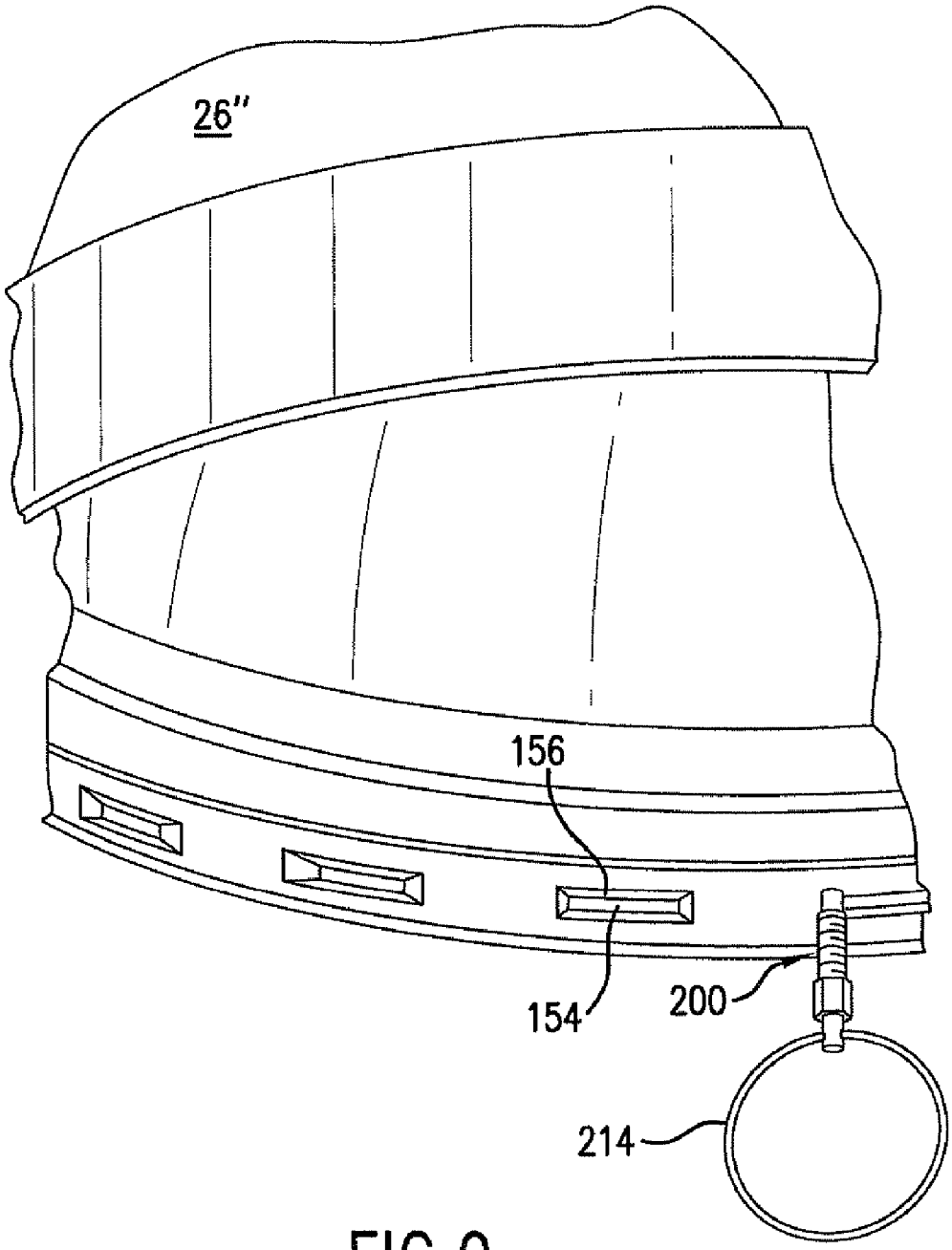
FIG. 9 is a perspective view of a portion of an upper hemisphere with bayonet net coupling lugs and the locking pin from FIG. 8 shown in position.

Referring now more specifically to FIGS. 6 and 7, the upper frame assembly 96 is assembled to the upper rim 102 and the lower frame assembly 94 is shown disassembled and adjacent to the lower rim 100. The lower and upper frame assemblies 94 and 96 are substantially identical. As is apparent from FIG. 6, brackets 110, 112, 114 and 116 forming frame assemblies 94 and 96 have complementary slots 120, 122, 124, 126 and 128 which receive brackets 110-116 so as to nest to brackets together in interlocking relationship. As is seen with the assembled upper frame assembly 96 on the upper rim 95, the brackets 110-116 have upper ends which are anchored by screws to the spokes of the lower rim 95. As is seen in FIG. 7, the brackets 110-116 of the upper frame assembly 96 have lower ends which are bolted to the upper hemisphere 26" of the cylindrical container 22' at an upper rim portion 132. Referring back to FIG. 5, the lower hemisphere 24" receives a quantity of waste material such as transuranic waste and the upper hemisphere 26" is attached rotatably to the lower hemisphere utilizing a bayonet connection 144 (FIGS. 8 and 9). This is accomplished by a spanner 146 that attaches to the upper hemisphere and rotates the upper hemisphere through a relatively small angle of about 20°.

The brackets 94 and 96 of each frame assembly 94 and 96 shown in FIG. 6 have arcuate, inwardly facing surfaces 147 which abut the hemispherical outer surfaces 148 and 149 of the hemispheres 24 and 26 when the brackets are assembled as shown in FIGS. 7 and 5.

Referring now to FIGS. 8 and 9 it is seen that the lower hemisphere 24" has projecting lugs 150, wherein the projecting lugs 150 have lower surfaces 152 which are beveled at a 30° angle to help center cooperating inwardly projecting lugs 154 (see FIG. 9) of the upper hemisphere 26." The lugs 154 of FIG. 9 have upper beveled surfaces 156 which are also angled to cooperate with the surfaces 152 so as to center the upper hemisphere 26" with respect to the lower hemisphere 24". The surfaces 156 and 152 are also arcuate portions of a helix so that as one rotates the upper hemisphere 26" with respect to the lower hemisphere 24", the upper hemisphere is cammed downwardly toward the lower hemisphere. The bayonet connection 144 illustrated in FIGS. 7, 8 and 9 allows one to make a tight fitting connection with only 20° of rotation using the spanner 146 of FIG. 7.

Figure 10:
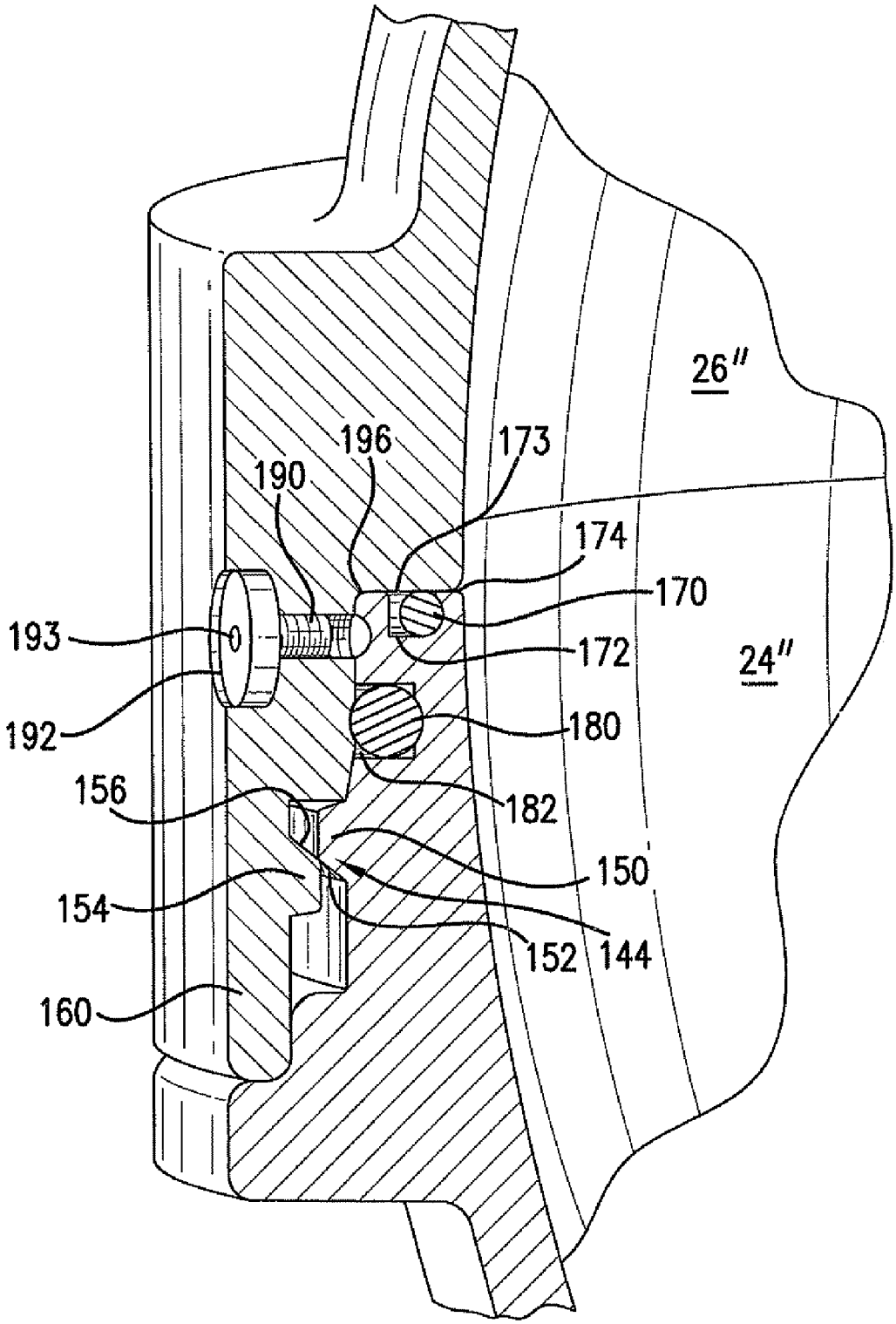
FIG. 10 shows a sampling portion between axial and radial seals.

Referring now to FIG. 10 there is shown a section through the assembly of the upper hemisphere 24" and the lower hemisphere 26", wherein the upper hemisphere has a lip 160 having the projecting lugs 156 thereon which cooperate with the projecting lugs 150 on the lower hemisphere 24" to positively lock the upper hemisphere 26" to the lower hemisphere 24" as the hemispheres are rotated with respect to one another. As is seen in FIG. 10, there are two O-ring seals, a compression seal 170 positioned in an upwardly opening groove 172 in the upper edge 174 of the lower hemisphere 24" and a radial seal 180 that is positioned in a radially opening groove 182 positioned below the axial seal 170 and slightly outboard of the axial seal 170. As the upper hemisphere 26' is drawn down by interaction of the lugs 150 and 154, the upper seal 170 is compressed to prevent radial leakage of gases or fluids from the space in the spherical container 22" while the radial seal 180 prevents axial leakage of fluid which may have leaked between the seal 170 and the lower edge of shoulder 173 of the upper hemisphere 26".

As is also seen in FIG. 10 there is a port 190 which allows sampling of the area or space between the upper axial seal 170 and the lower radial seal 180 to determine is there is fluid by passing the upper radial seal. The port has a sampling insert 192 therein that has an opening 193 thereto that is aligned with a self-sealing plug so that a hypodermic sampling needle may be inserted through the insert 92 to sample gas in the area 196.

Referring back to FIG. 5, another self-sealing sampling port 200 is provided into the top of upper hemisphere 26" so that gas therein may be sampled with a hypodermic needle.

Optionally a filtered vent may be installed in the upper hemisphere 26" of the spherical container 22" to vent gases accumulating in the container.

In order to lock the upper hemisphere 26" with respect to the lower hemisphere 24" after the upper hemisphere has been rotated using the scanner 146, a self-locking pin 210 is used. The self-locking pin 210 is spring projected and is initially cammed down upon rotating the hemispheres with respect to one another. In order to open the hemispheres, the locking pin is dislodged by pulling on a loop 214.

From the foregoing description, one skilled in the art can easily ascertain the essential characteristics of this invention, and without departing form the spirit and scope thereof, can make various changes and modifications of the invention to adapt it to various usages and conditions.

We claim:

1. A storage container for storing transuranic hazardous material, comprising:

first and second hemispheres that when coupled to one another enclose a spherical space for containing the transuranic material;

a coupling for joining the first and second hemispheres to one another, the coupling comprising annular rims on the first and second hemispheres, the annular rims having complementary surfaces that engage upon rotating the hemispheres with respect to one another about a common axis with the rims in contact to prevent the hemispheres from being separate; and a gasket between opposed annular portions of the rims, the gasket being compressed as relative rotation of the hemispheres advances one hemisphere toward the other, and a support arrangement for the storage container in a barrel wherein the support arrangement includes a vertical strut for holding the storage container spaced relation to a bottom of the barrel and a plurality of straps extending from a rim of the storage container for laterally supporting the storage container is spaced relation to the vertical wall of the barrel.

2. The storage container of claim 1 wherein the coupling comprises complementary helical threads on the annular rims.

3. The storage container of claim 1 wherein the coupling comprises complementary cams on the rims which engage to form a bayonet coupling.

4. The storage container of claim 1 wherein the hemispheres are made of aluminum or stainless steel.

5. The storage container of claim 1 wherein a filtered vent is placed therein to vent gas from the container emitted by the material.

6. The storage container of claim 1 wherein the transuranic material includes solutions and salts of plutonium.

7. The storage container of claim 1 further comprising U-shaped handles on both hemispheres to facilitate rotation of the hemispheres.

8. The storage container of claim 7 wherein the U-shaped handles are pivoted on the hemispheres to fold down toward the hemispheres.

9. The storage container of claim 1 further comprising a frame for supporting the storage container wherein the frame has a flat base and a flat top supported by vertical brackets.

10. The storage container of claim 9 wherein the vertical brackets include strut portions with inwardly facing surfaces that abut and support the hemispheres.

11. A storage container for storing transuranic hazardous material, comprising:

first and second hemispheres that when coupled to one another enclose a spherical space for containing the transuranic material;

a coupling for joining the first and second hemispheres to one another, the coupling comprising annular rims on the first and second hemispheres, the annular rims having complementary surfaces that engage upon rotating the hemispheres with respect to one another about a common axis with the rims in contact to prevent the hemispheres from being separate;

a gasket between opposed annular portions of the rims, the gasket being compressed as relative rotation of the hemispheres advances one hemisphere toward the other, and a frame for supporting the storage container wherein the frame has a flat base and a flat top supported by vertical brackets, the vertical brackets including strut portions with inwardly facing surfaces that abut and support the hemispheres.

12. The storage container of claim 11 further including a support arrangement for the storage container in a barrel wherein the support arrangement includes a vertical strut for holding the storage container spaced relation to a bottom of the barrel and a plurality of straps extending from a rim of the storage container for laterally supporting the storage container in spaced relation to the vertical wall of the barrel.

* * * * *